US011058214B2

(12) United States Patent
Alinski

(10) Patent No.: US 11,058,214 B2
(45) Date of Patent: Jul. 13, 2021

(54) TUFT PICKER FOR A BRUSH MAKING MACHINE

(71) Applicant: The Procter & Gamble Company, Cincinnati, OH (US)

(72) Inventor: Jens Alinski, Kelkheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 35 days.

(21) Appl. No.: 16/449,801

(22) Filed: Jun. 24, 2019

(65) Prior Publication Data

US 2019/0374020 A1 Dec. 12, 2019

Related U.S. Application Data

(63) Continuation of application No. PCT/US2018/014409, filed on Jan. 19, 2018.

(30) Foreign Application Priority Data

Jan. 24, 2017 (EP) ..... 17152765

(51) Int. Cl.
*A46D 3/08* (2006.01)
*A46D 1/08* (2006.01)
*A46D 1/00* (2006.01)

(52) U.S. Cl.
CPC ..... *A46D 3/082* (2013.01); *A46D 1/08* (2013.01); *A46D 1/0238* (2013.01); *A46D 1/0284* (2013.01)

(58) Field of Classification Search
CPC ..... A46D 1/0284; A46D 1/08; A46D 3/082; A46D 3/08
USPC ..... 300/4, 7, 8, 9, 21
See application file for complete search history.

(56) References Cited

U.S. PATENT DOCUMENTS

| | | | | |
|---|---|---|---|---|
| 1,664,424 A | | 4/1928 | Conrad | |
| 2,349,532 A | | 5/1944 | West | |
| 3,167,355 A | | 1/1965 | Aldrich | |
| 3,606,472 A | | 9/1971 | Rutkowski | |
| 4,174,029 A | * | 11/1979 | Kawaguchi | A46D 1/08 198/431 |

(Continued)

FOREIGN PATENT DOCUMENTS

| | | |
|---|---|---|
| BE | 765338 | 8/1971 |
| CN | 201468419 | 5/2010 |

(Continued)

OTHER PUBLICATIONS

Translation of Wo2010021138 retrieved from Espacenenet Jan. 8, 2021 (Year: 2010).*

(Continued)

*Primary Examiner* — Laura C Guidotti
*Assistant Examiner* — Thomas Raymond Rodgers
(74) *Attorney, Agent, or Firm* — Vladimir Vitenberg

(57) ABSTRACT

A tuft picker for a brush-making machine for automated production of brushes, such as toothbrushes, which is adapted to remove filaments from a filament container. The tuft picker comprises two parts. Each of the two parts comprises at least one picker eye for taking up a predefined number of loose filaments from the filament container. These picker eyes comprise an opening which can be opened and closed by moving the cover tool from a first position into a second position during one working stroke.

14 Claims, 10 Drawing Sheets

(56) References Cited

U.S. PATENT DOCUMENTS

| | | | | |
|---|---|---|---|---|
| 4,733,917 | A | 3/1988 | Boucherie | |
| 4,968,102 | A | 11/1990 | Boucherie | |
| 5,033,797 | A | 7/1991 | Rueb | |
| 5,165,759 | A | 11/1992 | Lewis, Jr. | |
| 5,344,218 | A | 9/1994 | Weihrauch | |
| 5,728,408 | A | 3/1998 | Boucherie | |
| 6,079,788 | A | 6/2000 | Boucherie | |
| 6,086,373 | A | 7/2000 | Schiff | |
| 6,138,314 | A | 10/2000 | Schiff | |
| 6,290,302 | B1 | 9/2001 | Boucherie | |
| 6,290,303 | B1 | 9/2001 | Boucherie | |
| 6,905,176 | B2 | 6/2005 | Boucherie | |
| 7,635,169 | B2 | 12/2009 | Boucherie | |
| 8,172,336 | B2 | 5/2012 | Boucherie | |
| 9,192,227 | B2 | 11/2015 | Stein et al. | |
| 10,398,220 | B2 | 9/2019 | Alinski | |
| 2001/0026093 | A1 | 10/2001 | Boucherie | |
| 2004/0164604 | A1 * | 8/2004 | Boucherie | A46D 1/05 300/5 |
| 2005/0116528 | A1 | 6/2005 | Boucherie | |
| 2010/0066154 | A1 | 3/2010 | Boucherie | |
| 2012/0013169 | A1 | 1/2012 | Rees | |
| 2013/0038115 | A1 | 2/2013 | Stein et al. | |
| 2016/0157599 | A1 | 6/2016 | Kumpf et al. | |
| 2017/0065072 | A1 | 3/2017 | Alinski | |
| 2017/0065073 | A1 | 3/2017 | Alinski | |
| 2019/0307241 | A1 | 10/2019 | Alinski | |

FOREIGN PATENT DOCUMENTS

| | | | | |
|---|---|---|---|---|
| CN | 201468429 | | 5/2010 | |
| CN | 201468430 | U | 5/2010 | |
| DE | 2128774 | | 10/1972 | |
| DE | 3016790 | | 11/1981 | |
| DE | 4040297 | | 6/1992 | |
| DE | 4411652 | | 10/1995 | |
| DE | 19728442 | | 1/1999 | |
| DE | 19745024 | | 4/1999 | |
| DE | 19939333 | | 2/2001 | |
| DE | 20319767 | | 6/2005 | |
| DE | 102005045827 | | 3/2007 | |
| DE | 102005056968 | | 5/2007 | |
| DE | 102007047066 | | 4/2009 | |
| DE | 102008059121 | | 5/2010 | |
| EP | 0016508 | | 10/1980 | |
| EP | 0206385 | | 12/1986 | |
| EP | 0289676 | | 11/1988 | |
| EP | 0346965 | | 12/1989 | |
| EP | 0432868 | | 6/1991 | |
| EP | 0681796 | | 11/1995 | |
| EP | 0916283 | | 5/1999 | |
| EP | 1522234 | | 4/2005 | |
| EP | 2654501 | | 10/2013 | |
| GB | 418967 | | 11/1934 | |
| GB | 381146518 | | 3/1969 | |
| JP | 05015412 | | 1/1993 | |
| JP | 06277119 | | 10/1994 | |
| JP | 2003169719 | | 6/2003 | |
| WO | W0200010814 | | 3/2000 | |
| WO | W0200949850 | | 4/2009 | |
| WO | WO-2010021138 | A1 * | 2/2010 | A46D 3/04 |
| WO | 2013024851 | A1 | 2/2013 | |
| WO | 2014050863 | A1 | 4/2014 | |

OTHER PUBLICATIONS

International Search Report PCT/US2018/014409 with written opinion, dated Jun. 29, 2018, 12 pages.

Extended European Search Report and Search Opinion; Application Ser. No. 17152765.8; dated Jul. 27, 2017; 7 pages.

* cited by examiner

TUFT PICKER FOR A BRUSH MAKING MACHINE

FIELD OF THE INVENTION

The invention is directed to brush-making machines for automated production of brushes, and more particular toothbrushes.

BACKGROUND OF THE INVENTION

The bristle field of modern toothbrushes comprises multiple filament tufts. A filament tuft comprises a predefined number of individual filaments which are arranged to each other with parallel length axes. During manufacturing of toothbrushes these filament tufts are separated from a filament reservoir, also known as filament container, comprising a plurality of filaments loosely arranged with parallel length axes. One side of the filament container is open or comprises an opening so that the filaments can be transferred continuously against said opening. At the opening the filaments can be taken out by a tuft picker. Said tuft picker comprise at least one picker eye which dimension is identical to the dimension of the filament tuft to be produced. Different tuft pickers are known in the state of the art, e.g. devices comprising picker eyes of different size (U.S. Pat. No. 7,635,169B2) or shape (US 2013/0038115 A1). Although these devices are used as standard in toothbrush manufacturing techniques, the filaments undergo wear, tension and mechanical stress. These problem including the damage to the filaments significantly increase, if non-standard filaments shall be used which do not comprise a more or less homogeneous surface and diameter over the whole length or are significantly thinner than the standard filaments.

Toothbrush development focuses on cleaning performance looking continuously for new filaments with a different cleaning property compared to the standard round filaments. Nowadays, irregular filaments, in particular filaments comprising depressions, recesses or the like along their length axes came into fashion as these filaments take up the removed dust and complement during cleaning performance. Prominent examples for said new kind of filaments are X-shaped filaments. Another example of irregular filaments is a tapered filament, which ends become significantly thinner in order to provide a cleaning performance comparable to the use of floss. For the same reason super-thin filaments may also be used.

Unfortunately, none of the latter filaments can be processed properly with the present manufacturing devices in particular the picking process does not work properly for these filaments.

The problems are inter alia splicing of filaments, picking different numbers of filaments up to picking no filaments and/or loosing picked filaments after having picked them so that filament tufts of non-standard filaments cannot be formed properly at the moment. In particular splicing of filaments causes problems for the final toothbrush as sharp edges might hurt the gum of the toothbrush user.

Thus, a need exists for a new tuft picker which is adapted to pick non-standard filaments and reduces mechanical stress to standard filaments and the devices used during the picking process. Thus, it is the object of the present application to provide such a new tuft picker which picks non-standard filaments, such as X-shaped filaments, tapered filaments or super-thin filaments, with a high operational reliability regarding number of filaments and without any splicing.

SUMMARY OF THE INVENTION

There is provided a tuft picker for a brush making machine for automated production of brushes, in particular toothbrushes. The tuft picker is adapted to remove filaments from a filament container which provides multiple loose filaments. The tuft picker as disclosed herein comprises two parts which are spaced by a cover tool. In addition, the tuft picker comprises at least one picker eye for taking up a predefined number of loose filaments from the filament container. The picker eye comprises an opening which can be opened and closed by moving the cover tool from a first position into a second position. During one working stroke of the tuft picker the working surface of the tuft picker comprising the at least one picker eye is transferred along the loose filaments twice, wherein the opening of the picker eye is open during the first passing and closed during the reverse movement of the tuft picker. Thereby, the filaments located in the picker eye are securely stored in the space of the picker eye and covered against mechanical abrasion and wear.

In accordance with one aspect, there is provided a tuft picker comprising a first part and a second part spaced by a distance, wherein the first part and the second part each comprise a working surface comprising each at least one picker eye with an opening in the working surface, wherein the opening of the first part and the opening of the second part are located at identical positions at the working surfaces and are spaced by the distance, thereby forming a picker eye volume comprising the picker eye from the first part and the picker eye from the second part and the interspace in between; and a cover tool located between the first part and the second part, wherein the cover tool comprises a hook which is connected by a spacer to a main body, wherein the hook comprises a first surface and a second surface, wherein the form of the first surface corresponds to the working surfaces at the openings and wherein the cover tool is movable relative to the picker eye volume from a first position to a second position, wherein the hook is located outside the picker eye volume in the first position of the cover tool and is located in the second position of the cover tool in such that it limits the picker eye volume at the interspace at the common building line of the working surfaces.

In accordance with another aspect, there is provided a brush making machine comprising a tuft picker as disclosed herein.

In accordance with another aspect, there is provided a method of providing filament tufts comprising a predefined number of filaments for the manufacturing of brushes, in particular toothbrushes, preferably using a tuft picker as disclosed herein comprising:

providing filaments in a filament container, wherein the filaments are continuously transferred against and open side of the filament container;

passing at least one picker eye volume comprising at least two picker eyes spaced by a distance and the interspace between the at least two picker eyes along the open side of the filament container in order to let filaments being transferred from the container into the picker eye volume;

removing filaments from the openings of the at least two picker eyes by sliding a hook of a cover tool into the picker eye volume such that the hook limits the picker eye volume at the interspace between the at least two picker eyes at the common building line of the picker eye openings; and transferring the filaments located in the closed picker eye volume to a removal device, which removes the filaments from the picker eye volume.

The method is preferably performed by using a tuft picker as disclosed herein.

The method as disclosed herein is in particular suitable for non-standard filaments. Thus, in accordance with another aspect, there is provided a brush, in particular a toothbrush, comprising at least on filament tuft comprising at least one non-standard filament.

BRIEF DESCRIPTION OF DRAWINGS

These and other features will become apparent not only from the claims but also from the following description and the drawings, with the aid of which example embodiments are explained below.

DETAILED DESCRIPTION OF THE INVENTION

Figure 1:
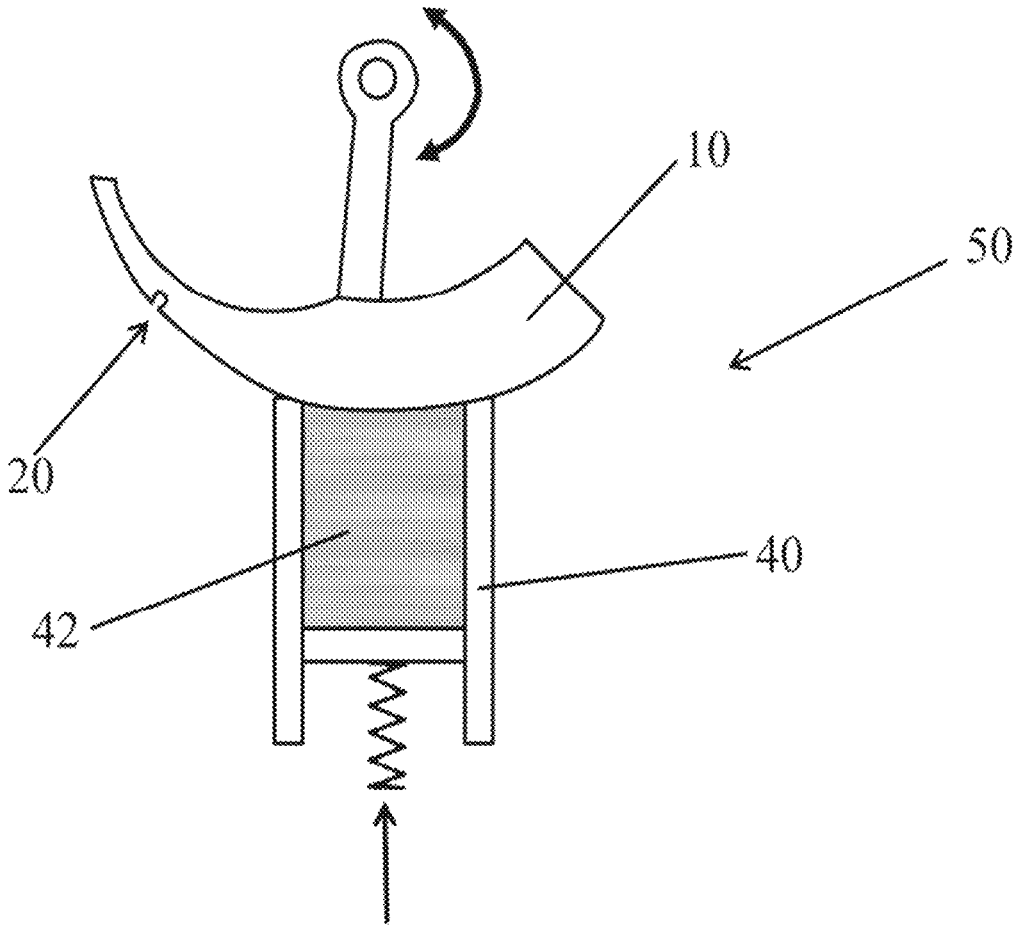
FIG. 1 shows a schematic sketch of a tuft picking device for brush making machines comprising a tuft picker with a picker eye.

The following is a description of numerous versions of a tuft picker comprising a tuft picker suitable to provide standard and non-standard filaments, such as shaped filaments, in particular X-shaped filaments, tapered filaments or super-thin filaments for brush production, in particular for toothbrush production. The description further discloses a method using said tuft picker which can be used to produce (tooth)brushes and the produced toothbrushes themselves. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein. In addition, single features or (sub)combinations of features may have inventive character irrespective of the feature combination provided by the claims, the respective part of the specification or the drawings.

By "cm" as used herein is meant centimeter. By "mm" as used herein is meant millimeter. By "μm" or "microns" as used herein is meant micrometer. By "mil" as used herein is meant a thousandth of an inch.

As used herein, the word "about" means +/− 10 percent.

As used herein, the word "comprise," and its variants, are intended to be non-limiting, such that recitation of items in a list is not to the exclusion of other like items that may also be useful in the materials, devices, and methods of this invention. This term encompasses the terms "consisting of" and "consisting essentially of".

As used herein, the word "include," and its variants, are intended to be non-limiting, such that recitation of items in a list is not to the exclusion of other like items that may also be useful in the materials, devices, and methods of this invention.

As used herein, the words "preferred", "preferably" and variants, such as "in particular" and "particularly" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

There is provided a tuft picker for a brush making machine. The tuft picker is able to pick a predefined number of filaments from a filament container which provides a supply of loose filaments in a mutually parallel condition. The circumference of the loose filaments may substantially round or the circumference may comprise at least one recess or may alter along the length axis of the filaments. A "filament container" as understood herein shall comprise any container of any geometrical shape which is suitable to store the loose filaments in parallel. A plurality of filaments is arranged in the filament container along their length axis. That means each filament element is arranged with its length axis in parallel to the adjacent filaments. The filament container comprises one open side or an opening is present in one side wall. At that opening the filaments are exposed to the environment, in particular are exposed to a tuft picker as disclosed herein and can be removed from the filament container by said tuft picker. Opposite to the opening of the filament container a plunger etc. might be arranged which continuously presses the loose filaments against the open side of the filament container.

Filaments may be for example monofilaments made from plastic material. Suitable plastic material used for filaments may be polyamide (PA), in particular nylon, polybutylterephthalate (PBT), polyethylterephthalate (PET) or mixtures thereof. In addition, the filament material may comprise additives such as abrasives, color pigments, flavors etc. For example an abrasive such as kaolin clay may be added and/or the filaments may be colored at the outer surface in order to realize indicator material. The coloring on the outside of the material is slowly worn away during use to indicate the extent to which the filament is worn. Suitable additives to filaments used for tuft filaments are for example UV-brighteners, signaling substances, such as the indicator color pigments and/or abrasives. The diameter of the filament may be in the range from about 0.1 mm to about 0.5 mm, in particular in the range from about 0.15 to about 0.4 mm, more particular in the range of about 0.18 mm to about 0.35 mm or any other numerical range which is narrower and which falls within such broader numerical range, as if such narrower numerical ranges were all expressly written herein.

In addition, to the standard filaments having the diameters as given above super-thin filaments are used in toothbrushes. Super-thin filaments have a smaller diameter compared to standard filaments and may act like floss during normal brushing. The diameter of super-thin filaments may be in the range from about 0.05 mm to about 0.15 mm, in particular in the range from about 0.07 mm to about 0.13 mm, more particular in the range of about 0.09 mm to about 0.11 mm or any other numerical range which is narrower and which falls within such broader numerical range, as if such narrower numerical ranges were all expressly written herein. Filament diameters are produced with a tolerance of 10%.

In addition to filaments with a substantially constant diameter filaments may also be used which diameter decreases towards the ends. These kind of tapered filaments are based on standard diameter filaments which ends are chemically tapered. Suitable tapered filaments are provided for example by BBC, Korea.

In addition, filaments may be used for toothbrushes which comprise an irregular diameter, i.e. which comprise at least one recess. A "recess" as understood herein in the filament circumference, diameter and/or volume shall mean any depression, cavity, slot or other geometric recess which amends the filament volume. The filament comprising at least one recess in its circumference may comprise one or more recesses along the circumference of the filament. A suitable example for a filament comprising at least one recess is an X-shaped filament. X-shaped filaments comprise four recesses and two lines of reflection symmetry each crossing two recesses which are located opposite to each other. In addition, all four recesses might be equal. The included angle of the X-shape filaments might be in the range of from about 40° to about 160°.

Length of the filaments depends on the intended use. Generally, a filament can be of any suitable length for transporting, such as about 1300 mm and is then cut into pieces of the desired length. The length of a filament in a toothbrush influences the bending forces needed to bend the filament. Thus, the length of a filament can be used to realize different stiffness of filaments in a brush pattern. The typical length of a filament for a brush, in particular a toothbrush, may be in the range from about 5 mm to about 18 mm, in particular in the range from about 6 mm to about 15 mm, more particular in the range of about 7 mm to about 13 mm or any other numerical range which is narrower and which falls within such broader numerical range, as if such narrower numerical ranges were all expressly written herein. The filaments to be picked with a tuft picker as disclosed herein may be mounted to a brush by anchor wires. These filaments typically have a doubled length compared to the filaments which are mounted to a brush by anchor free techniques. In addition the filaments may be longer than the final filament length in the resulting brush head so that the filaments can be cut to different specific final lengths after picking them. The filaments to be picked may be longer than the final filaments in the range from about 0.5 mm to about 5 mm, in particular in the range from about 1 mm to about 4 mm, more particular in the range of about 1.5 mm to about 3 mm or any other numerical range which is narrower and which falls within such broader numerical range, as if such narrower numerical ranges were all expressly written herein. In particular, if the brushes are manufactured by anchor technology all filament tufts are mounted into the brush head first and then the filaments are cut into their final length. After cutting the cut ends are end-rounded in order to remove the sharp ends which could hurt the gums of the user of the brush. The process of end-rounding comprises several successive polishing steps, preferably using decreasing abrasiveness. If tapered filaments or super-thin filaments shall be used the standard filaments are cut into length and are end-rounded first before the tapered or the super-thin filaments may be mounted to the brush in order not to alter the ends of the tapered or super-thin filaments. Alternatively, the tapered or super-thin filaments may be bent away during cutting and end-rounding of the standard filaments.

The filaments in a brush head, in particular in a toothbrush head, are grouped in filament tufts. A suitable number of filaments to form one filament tuft may be for example in the range of about 10 to about 80, or in the range of about 15 to about 60, or in the range of about 20 to about 50, or any other numerical range which is narrower and which falls within such broader numerical range, as if such narrower numerical ranges were all expressly written herein. The predefined number of filaments which shall form one filament tuft is separated from the filament container mechanically, i.e. by a picking process, in particular by a picking process as disclosed herein. "Picking" as understood herein shall mean that filaments are pushed perpendicular to their length axis continuously from a filament container in the direction of a tuft picker as disclosed herein, wherein the tuft picker comprises at least one picker eye able to accept the predefined number of filaments. The picked number of filaments, named filament tuft, is then transferred to a brush making machine and mounted into a brush head.

A "tuft picker" as disclosed herein comprises at least two parts in equal shape which are spaced by a distance. The two parts each comprise a working surface comprising at least one picker eye. Said at least one picker eye is a recess along the working surface, thus comprising a depth, a width along the depth and an opening in/at the working surface. The first and the second part of the tuft picker are arranged to each other in such that the working surfaces are located in a common building line and the at least one picker eye(s) are arranged at identical positions at the working surfaces. Thereby a picker eye volume is formed comprising the picker eye in the first or upper part of the tuft picker, the picker eye in the second or lower part of the tuft picker and the interspace between them. In addition, the tuft picker may comprise one or more additional parts which are located between the first upper part and the second lower part of the tuft picker. The additional parts sandwiched between the first upper and second lower part all comprise the same picker eye which are located at identical positions to each other. If additional parts are arranged between the first upper and second lower part the interspace may be increased without risking that the filaments are bend or broken inside the picker eye volume. The number of additional parts is not limited and is chosen according to the size of the picker eye volume. The picker eye volume may be filled with filaments during a picking process, wherein one end of the filaments will protrude from the picker eye in the first part of the tuft picker and the other filament end will protrude from the picker eye in the second part of the tuft picker.

The distance between the first and second part of the tuft picker is constant and a cover tool is located in said interspace. If one or more additional parts of the tuft picker are located between the first upper and second lower part of the tuft picker more than one interspace is present in which a cover tool may be located. Each cover tool comprises a hook which is connected by a spacer to a main body. The hook of the cover tool comprises a first and a second surface, wherein the form of the first surface corresponds to the form of the working surfaces at the opening of the picker eyes. In addition, the main body of the cover tool is movably arranged between the first and the second part and optionally any additional part of the tuft picker, in particular the cover tool is movable relative to the picker eyes. In a first position of the cover tool the hook is located outside the picker eye volume formed by the two or more picker eyes and the interspace. In a second position the cover tool is located in such that the hook limits the interspace of the picker eye volume at the building line of the working surfaces. That means the picker eyes in the first and second part of the tuft picker are still open although the picker eye volume is closed at the building line of the working surfaces, i.e. relative to the outside of the tuft picker. If more than one picker eye is arranged at each working surface of the tuft picker, the one or more cover tools may also be designed to close the resulting more than one picker eye volumes successively.

The main body of the cover tool is movable relative to the picker eyes and the picker eye volume, respectively. In addition, the main body may be located partially inside the picker eye volume in the first position of the cover tool and less partially or completely outside the picker eye volume in the second position of the cover tool. That means the main body of the cover tool covers a part of the picker eye volume in the first position of the cover tool so that this part cannot be filled with filaments during a picking process. In particular, the part of the main body may cover the base of the picker eye volume. During the movement of the cover tool from its first position into its second position the main body will be removed from the picker eye volume thereby releasing the space covered before at least partially. That means filaments which are located inside the picker eyes and the picker eye volume may be transferred deeper into the picker eyes and the picker eye volume during the movement of the cover tool from its first into its second position. Parallel to the movement of the main body out of the picker eyes and the picker eye volume the hook is moved from its location outside the building line of the openings of picker eyes into the building line of the opening in the working surfaces. Thereby the volume which is covered by the part of the main body in the first position of the cover tool is identical or smaller to the volume covered by the hook in the second position of the cover tool. Thus, the volume of the picker eye volume which can be filled with filaments is identical in both, the first and the second position of the cover tool or the volume of the picker eye volume is larger in the second position of the cover tool. If the volume of the picker eye volume is larger in the second position, the volume is increased such that the filaments are still securely hold in the picker eye volume, but the slightly increased volumes simplifies transportation of the filaments deeper inside the picker eye volume.

The contour of the hook of the cover tool is adapted to transfer objects to be located inside the picker eye volume deeper into said volume. In particular, the second surface of the hook is adapted to transfer objects to be located inside the picker eye volume deeper into said picker eye volume and thereby adapted to transfer objects to be located inside the picker eye volume outside the building lines of the openings in the working surfaces of the first and second part of the tuft picker. For example the hook may be sickle shaped. In addition or alternatively, the end of the hook may be rounded so that the end of the hook does not clamp or damage the filaments picked. In addition or alternatively, the second surface of the hook which is the surface which is located inside the picker eye volume in the second position of the cover tool may be chamfered from the end, preferably the rounded end, of the hook to the base of the hook which is connected to the spacer of the cover tool. The width of the hook may increase from the end, preferable the rounded end, to the base of the hook at the connection to the spacer. A suitable width of the hook may be in the range from about 0.01 mm to about 0.1 mm at the end to about 0.1 mm to about 5 mm at the spacer, preferably from about 0.01 mm to about 0.05 mm at the end to about 0.2 mm to 1 mm at the spacer or any other numerical range which is narrower and which falls within such broader numerical range, as if such narrower numerical ranges were all expressly written herein.

In addition or alternatively, the picker eyes can principally be of any geometrical form as long as the picker eye in the first part of the tuft picker and the corresponding picker eye in the second part of the tuft picker are identical. The form of the picker eye may help to trap the filaments to be picked inside the picker eyes. The internal surface of the picker eye may be regularly or irregularly. An irregular internal surface of the picker eye may be preferred as any movement of the filaments in the picker eyes may be decreased thereby so that the picked filaments are easier stored inside the picker eye. Suitable forms of a picker eye are for example a circle, an oval, or a combination thereof. In particular, the picker eye may be an oval, wherein the depth of the picker eye is larger than the width of the picker eye. Said oblongness may help to pick filaments comprising at least one recess as well to keep the filaments in the picker eye during the movement of the tuft picker. For example, the picker eye may be an oval comprising a depth in the range of from about 0.5 mm to about 5 mm and a width in the range of from about 0.1 mm to about 3 mm, preferably a depth in the range of from about 1 mm to about 4 mm and a width in the range of from about 0.5 mm to about 1.5 mm or any other numerical range which is narrower and which falls within such broader numerical range, as if such narrower numerical ranges were all expressly written herein. Alternatively, the picker eye may be an oval wherein the width of the picker eye is larger than the depth of the picker eye. For example, the picker eye may be an oval comprising a width in the range of from about 1 mm to about 8 mm and a depth in the range of from about 0.4 mm to about 4 mm, preferably a width in the range of from about 1.5 mm to about 5 mm and a depth in the range of from about 0.5 mm to about 3 mm Said kind of picker eye may be in particular useful for tuft pickers comprising a straight working surface.

In addition or alternatively, the width of the picker eye may vary along the depth of the picker eye. That means the width at the base of the picker eye may be larger than the width of the opening of the picker eye. Variation of the width along the depth of the picker eye may help in keeping the filaments in the picker eye during the movement of the tuft picker. In addition or alternatively, the depth of the picker eyes may be adapted between two successively performed working strokes or a predefined number of performed working strokes. By varying the depth of the picker eyes, the size of the picker eye and the picker eye volume is varied. The size of the picker eyes and the picker eye volume corresponds to the predefined number of filaments picked which form one filament tuft after picking. That means if the size of the picker eye and the picker eye volume, respectively is varied, different filament tufts can be picked with one tuft picker.

The opening of the picker eyes may be reduced by two protrusions compared to the width of the picker eyes themselves. A top of the protrusions may be located in the working surface of the tuft picker so that the top of the protrusion may help to separate filaments from the filament container and may build a barrier in order to keep filaments which are already picked in the picker eye. Suitable protrusions limit the opening in the range of from about 0.025 mm to about 0.35 mm, preferably in the range of from about 0.5 mm to about 0.3 mm, more preferred from about 0.10 mm to about 0.25 mm or any other numerical range which is narrower and which falls within such broader numerical range, as if such narrower numerical ranges were all expressly written herein. That means the openings of the picker eyes are smaller than the width of the picker eye outside the building line of the working surfaces, namely the width is reduced by the size of the protrusions. In particular, the picker eyes may preferably comprise one protrusion protruding into the opening at the side of the opening where the end of the hook is located in the second position of the cover tool, i.e. where the end of the hook is located when it closes the opening of the picker eye. If the picker eye comprises a protrusion at said side the end of the hook may correspond to the form of said at least one protrusion in order to securely and firmly close the opening of the picker eye. In particular, the end of the hook may comprise the negative and/or opposite form of said at least one protrusion. In particular, the protrusion is designed such that a filament being separated from a filament container is automatically transferred deeper into the volume of the picker eye.

The contour of the working surfaces is adapted to be movable during a working stroke past an open side of a filament container. A "working stroke" as understood herein is any movement of the tuft picker which passes the opening of the picker eye along the loose filaments in a filament container, wherein filaments are transferred into the picker eye thereby being finally removed from the filament container. The contour of the working surfaces of a tuft picker may be straight or circular. That means a working stroke may be a linear movement or a circular movement depending on the contour of the tuft picker. Circular tuft picker are usually used in the prior art, but a linear tuft picker may also be suitable to be combined with the picker eye and the cover tools as disclosed herein. If the tuft picker is a circular arc the circular arc comprises preferably a curvature/diameter in the range from about 20 mm to about 200 mm, more preferred with a curvature/diameter in the range from about 40 mm to about 100 mm or any other numerical range which is narrower and which falls within such broader numerical range, as if such narrower numerical ranges were all expressly written herein.

During its movement the tuft picker may oscillate along a predefined form. For example, a linear tuft picker oscillates along a straight line and a curved tuft picker oscillates along a part of a circular art. Thereby the tuft picker oscillates from a starting position to a reversal point. During the movement of the tuft picker the cover tool is transferred from its first, i.e. open position into its second, i.e. closed position. In particular, the movement of the cover tool is faster than the movement of the tuft picker so that the cover tool reaches its second position before the tuft picker reaches the reversal point. That means the opening of the picker eye is closed by the hook of the cover tool before the tuft picker reaches the reversal point of its movement. Preferably, the cover tool is transferred from its first position into its second position near arriving the reversal point because the movement of the tuft picker is minimal near to the reversal point. During the movement of the tuft picker back into its starting position the cover tool may stay in its second position so that the opening of the picker eye is closed during said movement. As soon as the tuft picker has passed the loose filaments during its movement back or has reached again its starting position the cover tool can be moved back into its first position thereby opening the opening of the picker eye again. The filaments can be removed from the picker eye after first and/or second movement of the tuft picker.

Alternatively, the movement of the tuft picker may be unidirectional and continuously. For example the tuft picker may move rotate continuously. Suitable tuft picker for a rotational movement are circular arcs, circles or partial circles. Such a rotational movement may be combined with more than one picker eye so that the picking efficacy of the tuft picker is increased. For example, picker eyes with different sizes may be arranged at one tuft picker so that different filament tufts can be picked with one tuft picker. In addition or alternatively, the tuft picker may comprise picker eyes distributed over the whole working surface, or picker eyes may be grouped. The arrangement of more than one picker eye on a tuft picker may be e.g. adapted to the filament procession tools.

Linear tuft pickers with straight working surfaces may be also combined with more than one picker eye per tuft picker, wherein the picker eyes may be identical of different to each other. The linear movement of a linear tuft picker is usually an oscillating movement, wherein both movement directions may represent a working stroke, i.e. may pick up filaments from the filament container. If the tuft picker picks up filaments in both directions the picker eyes will be emptied at both sides of the filament container by a suitable filament processing tool. Alternatively, only one direction of the linear movement may represent a working stroke and the picker eyes may pass the filament container with closed cover tools in the reverse direction, wherein the picker eyes are still filled with filaments or already emptied.

In addition or alternatively, the present disclosure further provides a method of providing filament tufts for brush making production, in particular for toothbrush making production. Said filament tufts comprise a predefined number of filaments. A "predefined number of filaments" as understood herein mean a number which is set by the size of the picker eye of the tuft picker as disclosed herein and which is used in a picker device. Said predefined number may vary in the number of the selected and picked filaments in range of about 25% above or below the set number. The method comprises using at least a tuft picker, preferably as disclosed herein, and comprises further separating laterally the filaments from a quantity of loose fibers in order to form a filament tuft. The filaments to be picked comprise standard and non-standard filaments, such as super-thin filaments or tapered filaments or the filaments may comprise recesses, such as X-shaped filaments.

The method may comprise providing filaments in a filament container, wherein the filaments are continuously transferred against an open side of the filament container. Then, an opening of at least one picker eye volume is passed along said open side of the filament container in order to let filaments being transferred from the container into the picker eye. Then, the filaments which are located in the opening of the picker eye volume are removed from said opening by sliding a hook of a cover tool into said opening. Thereby the filaments are securely and firmly stored inside the picker eye volume and can easily be transferred for further processing. Thus, the method further comprises the step of transferring the filaments located in the closed picker eye volume to a removal device, which removes the filaments from the picker eye volume for further processing. The cover tool opens shortly before it arrives at the removal device by sliding the hook of the cover tool out of the opening of the picker eye volume. In parallel to the hook which is slid into and out of the opening of the picker eye volume a part of the main body of the cover tool slides out of and into the picker eye volume. That means in the open position of the hook a part of the main body of the cover tool is located at the basis of the picker eye volume and said part is removed from the volume of the picker eye when the hook slides into its closed position. If the hook slides back into its open position, a part of the main part of the body of the cover tool is moved into the basis of the picker eye volume again. As the volume which is covered by the part of the main body and the hook are identical the free space in the picker eye which can be filled with filaments is also identical independently of the position of the cover tool. Thus, the picked filaments are more or less clamped into the picker eye with continuous clamping force. Alternatively, the volume covered by the main part of the body of the cover tool is larger than the volume covered by the hook, so that the picker eye volume slightly increase by moving the cover tool from its first into its second position. The slightly increased picker eye volume makes it easier to remove the filaments from the openings of the picker eyes. The increase in the picker eye volume will be small enough to hold the filaments in the picker eye volume firmly.

In addition or alternatively, the present disclosure provides further a brush, in particular a toothbrush comprising at least one filament tuft comprising at least one non-standard filament, e.g. filaments which circumference comprise at least one recess, such a X-shaped filaments, or filaments which are tapered or super-thin filaments. Said brush is manufactured using a method and/or a tuft picker as disclosed herein. Preferably, the brush and/or toothbrush produced comprise at least one filament tuft comprising X-shaped filaments.

In the following, a detailed description of several example embodiments will be given. It is noted that all features described in the present disclosure, whether they are disclosed in the previous description of more general embodiments or in the following description of example embodiments of the devices, even though they may be described in the context of a particular embodiment, are of course meant to be disclosed as individual features that can be combined with all other disclosed features as long as this would not contradict the gist and scope of the present disclosure. In particular, all features disclosed for either one of the devices or a part thereof may also be combined with and/or applied to the other parts of the devices or a part thereof, if applicable.

FIG. 1 shows a schematic view of a tuft picking device 50 for brush making machines mounting filament tufts into a brush, in particular into a toothbrush. The tuft picking device 50 comprises at least a tuft picker 10 and a filament container 40. Further components which might belong to the tuft picking device 50 are not shown in order to facilitate FIG. 1. The filament container 40 is suitable for holding a plurality of loose filaments 42 in a mutually parallel condition. That means the filaments 42 are located with parallel length axes in the filament container 40, wherein the length axes of the filaments 42 are parallel to the side walls of the filament container 40. The filaments 42 may be for example monofilaments made from plastic material such as polyamide (PA), in particular PA 6.10 or PA 6.13. The diameter of the filament may be in the range from about 0.1 mm to about 0.5 mm or and the filaments may be cut into pieces of a length in the range of about 11 mm to about 46 mm.

The filament container 40 may be of any geometrical shape as long as the filaments 42 can be stored therein. For examples, the filament container 40 comprises two side walls which are immovable, one movable side wall and one open side. The movable side wall is located opposite to the open side and is moved into the direction of the open side, thereby moving the plurality of filaments 42 stored in the filament container 40 in the same direction. At the open side the filaments 42 are in contact with the tuft picker 10. The tuft picker 10 comprises at least one picker eye 20 which is suitable to take up filaments 42 from the filament container 40. The tuft picker 10 is attached to the tuft picking device 50 in such that the tuft picker 10 can be moved. The surface contour of the tuft picker 10 shown in FIG. 1 is a circular arc and the movement of the tuft picker 10 is a circular movement as well. A working stroke, meaning the movement of the tuft picker 10 that brings the picker eye 20 into contact with the filaments 42 located in the filament container 40 is a circular movement, in particular a oscillating movement. Preferably, the reversal point of the tuft picker 10 is located at the open side of the filament container 40. That means, the picker eye 20 may be e.g. moved up to the middle of the open side of the filament container 40, filled with filaments 42 and removed into the position outside the filament container 40 (as shown in FIG. 1). In the position outside the filament container 40 the filaments 42 can then be removed from the picker eye 20 in order to be mounted to a brush.

Figure 2A:
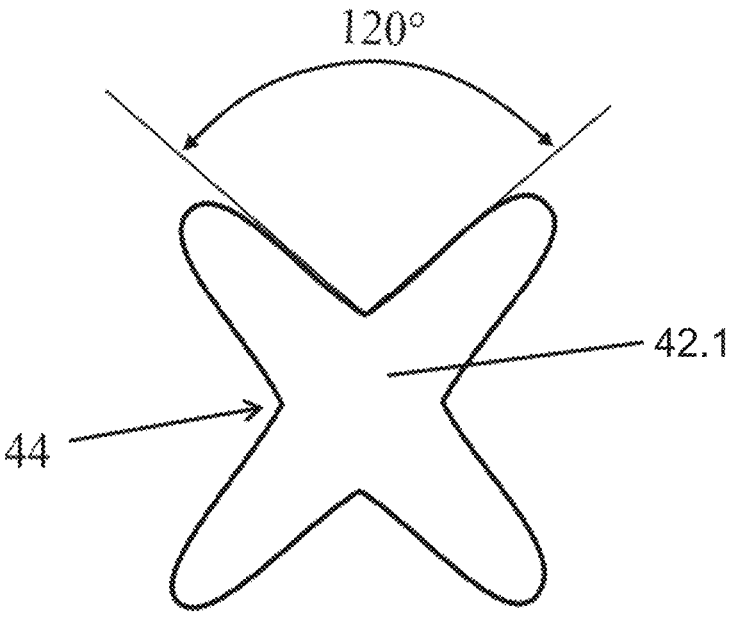
FIG. 2A shows a cross-sectional view of an embodiment of a filament having four recesses.
Figure 2B:
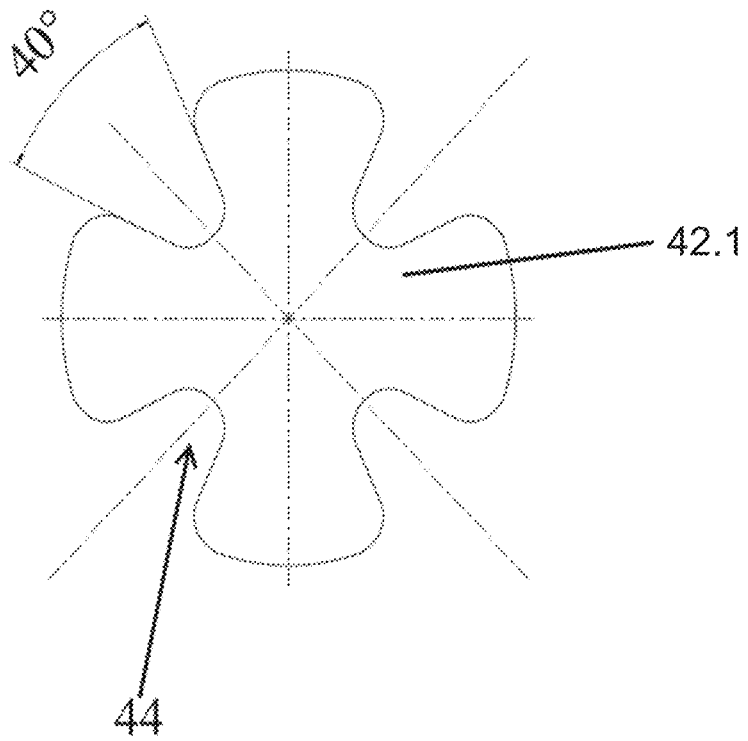
FIG. 2B shows a cross-sectional view of another embodiment of a filament having four recesses.

FIGS. 2A and 2B each show a schematic sketch of a filament 42.1 comprising four recesses 44 in its circumference. The four recesses 44 are arranged regularly around the circumference of the filament 42.1, thereby forming an X-shaped filament. Different forms and sizes of recesses are possible. The included angle of each of the recesses 44 of the X-shaped filament 42.1 may be in the range of from about 40° to about 160°. The included angle of the recesses 44 shown is about 120° in FIG. 2A and about 40° in FIG. 2B. The maximal dimension of the filament 42.1 may be in the range of from about 0.1 mm to about 0.5 mm. The depth of the recesses 44 is less than until the middle of the filament in order to have a robust bulk in the middle of the filament 42.1. A suitable depth of a recess 44 is in the range of about 0.025 mm to about 0.25 mm, preferably of about 0.04 mm to about 0.15 mm. The four recesses 44 may be equal to each other in form, shape, size and opening angle as shown or may be different to each other. Regarding X-shaped filaments 42.1 at least the two opposite recesses 44 are preferably equally formed compared to each other.

Figure 3A:
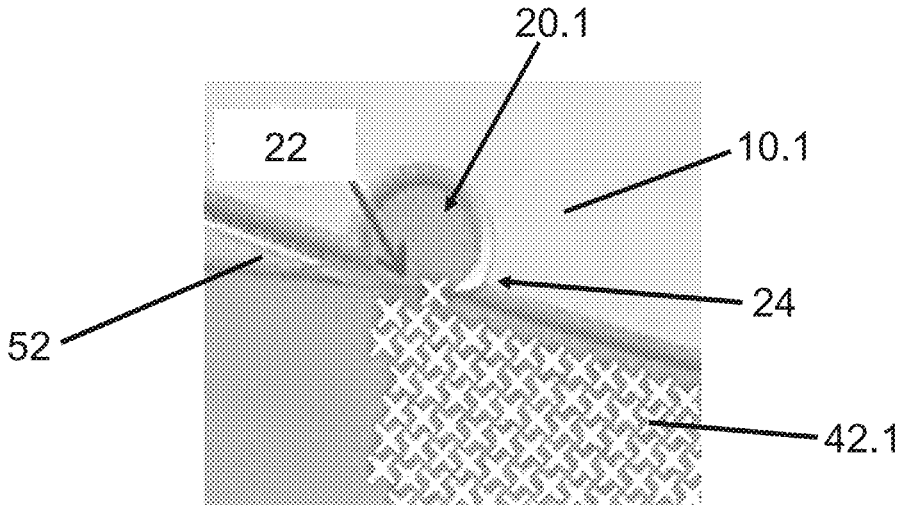
FIG. 3A Prior Art
FIG. 3A shows a schematic sketch of a prior-art conventional picker eye splicing an X-shaped filament.
Figure 3B:
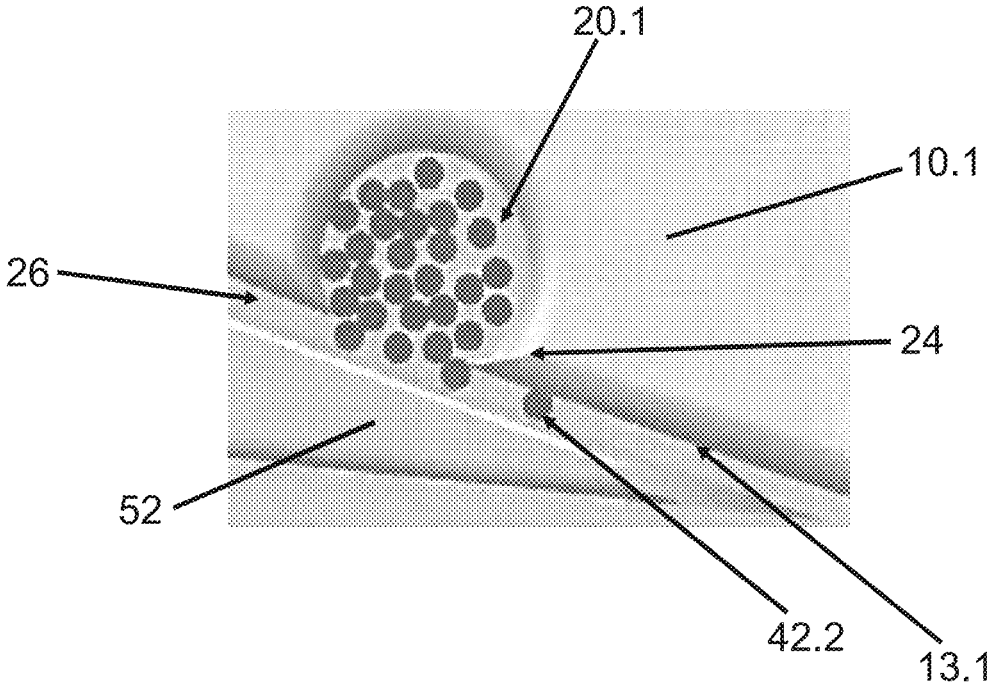
FIG. 3B Prior Art
FIG. 3B shows a schematic sketch of a prior-art conventional picker eye clamping a super-thin filament.

FIG. 3 show schematically the problems which occur, if a standard tuft picker 10.1 is used for non-standard filaments, e.g. X-shaped filaments 42.1 (FIG. 3A) or super-thin filaments 42.2 (FIG. 3B). The X-shaped filaments 42.1 are transferred into the picker eye 20.1 during the movement of the tuft picker 10.1. Thereby X-shaped filaments 42.1 may be located in the opening 22 of the picker eye 20.1. These filaments 42.1 will be spliced by a sharp projection 24 as soon as the opening 22 of the picker eye 20.1 is moved along a counterpart 52 of the tuft picker 10.1. If super-thin filaments 42.2 are processed with a standard tuft picker 10.1 the filaments 42.2 will be clamped in the gap 26 between the working surface 13.1 of the tuft picker 10.1 and the counterpart 52 (FIG. 3B).

Figure 4:
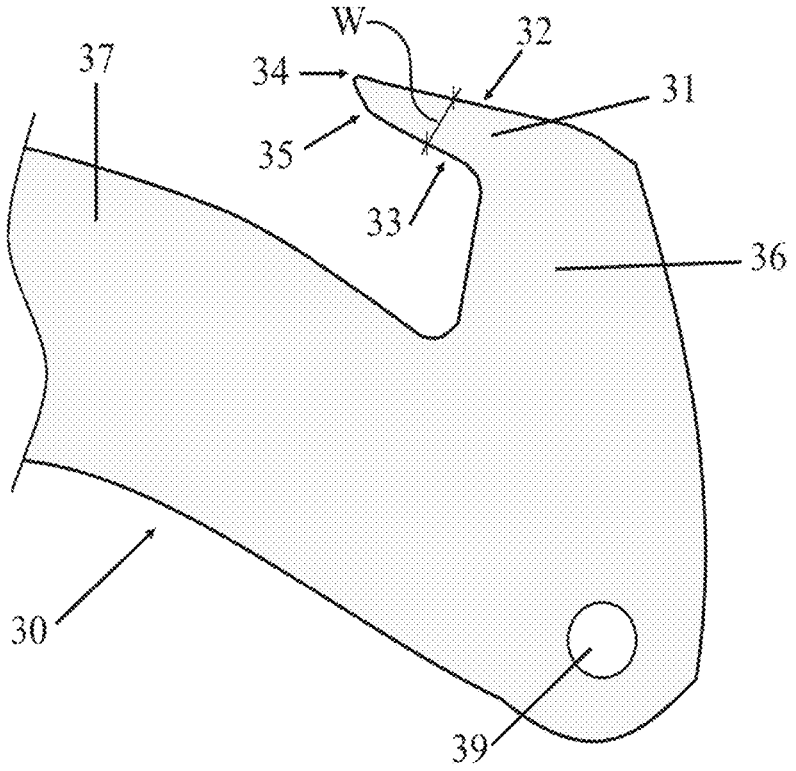
FIG. 4 shows a schematic view of a cover tool.
Figure 5A:
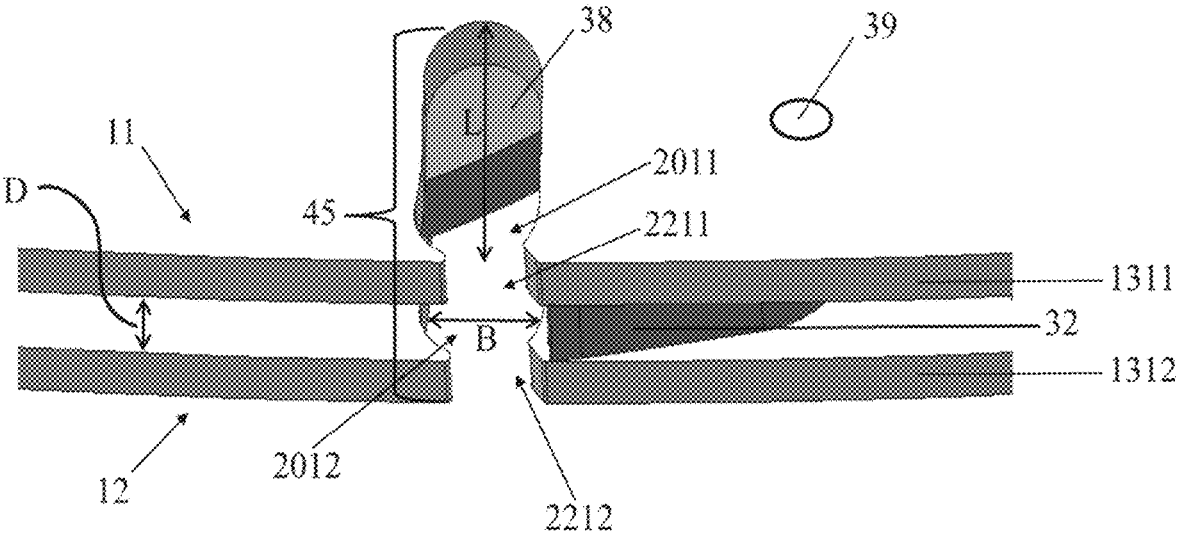
FIG. 5A shows a schematic sketch of an open picker eye volume comprising a first part a second part and a cover tool arranged in the distance between the two parts wherein the cover tool is arranged in its first position.
Figure 5B:
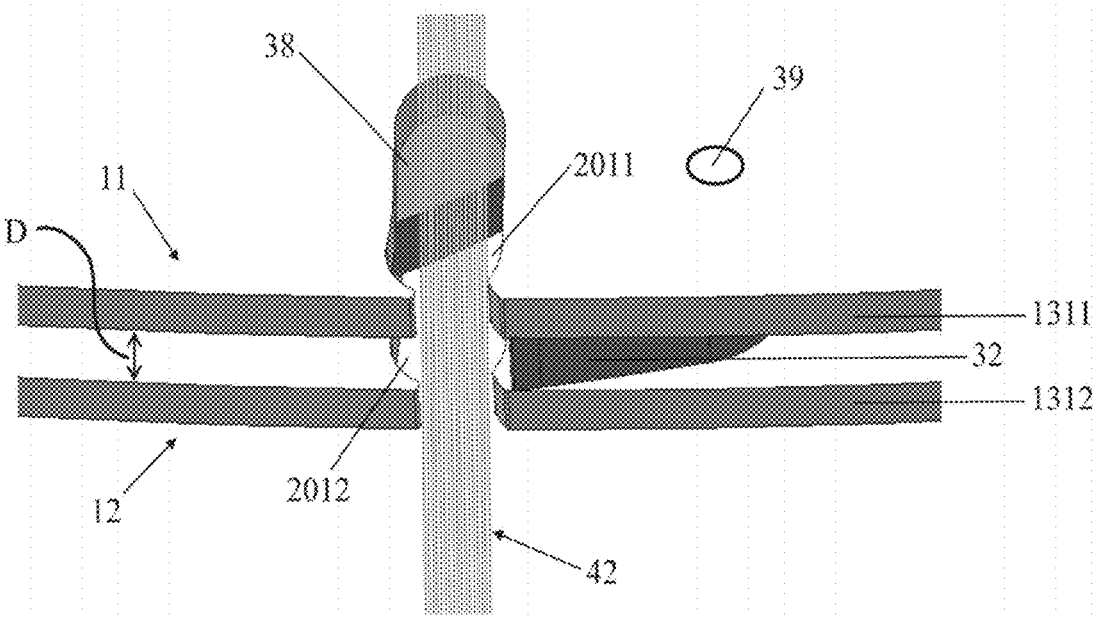
FIG. 5B shows a schematic sketch of the embodiment shown in FIG. 5A, wherein filaments are located in the picker eye volume.
Figure 5C:
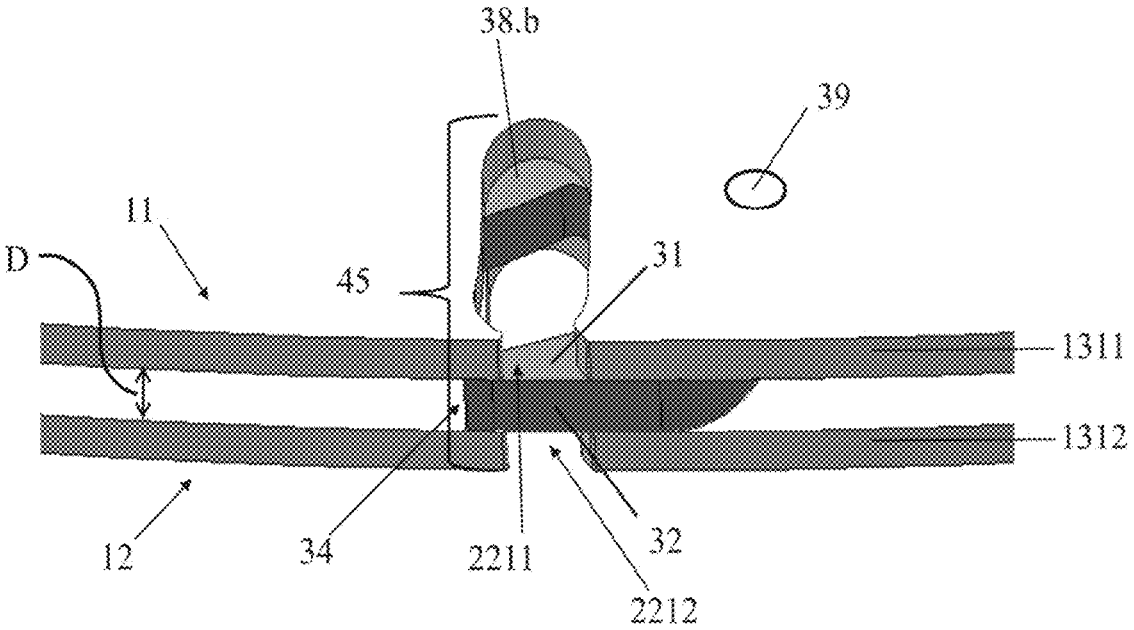
FIG. 5C shows a schematic sketch of the embodiment shown in FIG. 5A, wherein the cover tool is located in its second position.
Figure 6A:
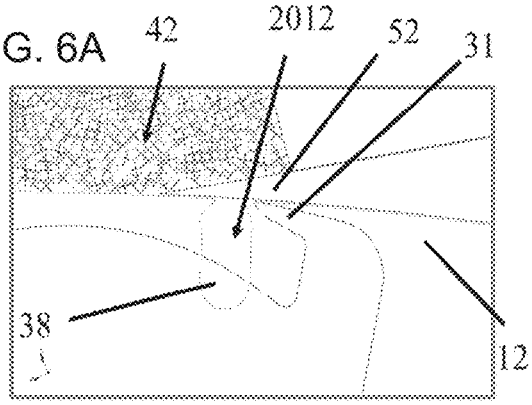
FIG. 6A illustrates a first position of a hook of an embodiment of a cover tool when a picker eye is not filled.
Figure 6B:
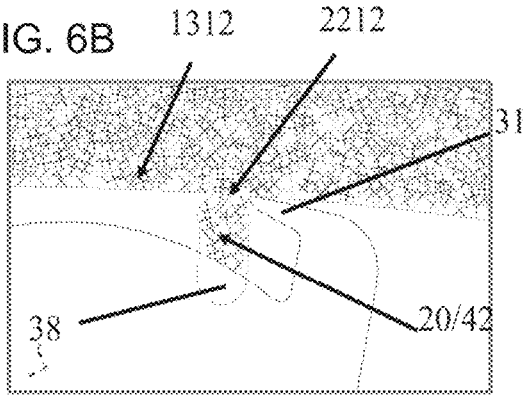
FIG. 6B illustrates the first position of the hook of the cover tool shown in FIG. 6A, when filaments are passing through an opening into the picker eye.
Figure 6C:
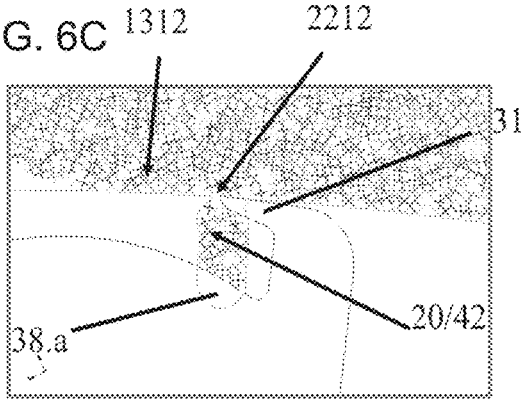
FIG. 6C illustrates a second position of the hook of the cover tool shown in FIGS. 6A and 6B.
Figure 6D:
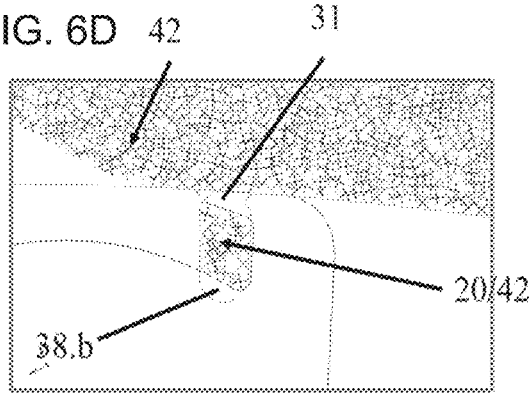
FIG. 6D illustrates a position of the hook of the cover tool shown in FIGS. 6A, 6B, and 6C, with filaments securely located in the picker eye.

FIG. 4 shows a schematic view of the cover tool 30 mounted between a first part 11 and a second part 12 of a tuft picker as shown in FIG. 5 as well as mounted between a first and third part 11, 14 and a third and second part 14, 12 of a tuft picker as shown in FIG. 6C. The cover tool 30 comprises a hook 31 which is connected via a spacer 36 to a main body 37. The cover tool 30 is mounted via a hinge 39 rotatable to the parts 11, 12 of the tuft picker. The hook 31 of the cover tool 30 comprises a first surface 32 and a second surface 33. The form of the first surface 32 corresponds to and is equal to the form of the working surfaces of the tuft picker. In particular, the form of the first surface 32 of the hook 31 is adapted to match the openings of the picker eyes. The two surfaces 32, 33 of the hook 31 are connected via an end 34 which is rounded in order not to damage the filaments to be picked. The first and the second surface 32, 33 are spaced by a width W which increases from the end 34 towards the connection of the hook 31 to the spacer 36. A suitable width W at the rounded end 34 is about 0.05 mm and a suitable width W at the connection of the hook 31 to the spacer 36 is about 0.4 mm. The second surface 33 may be buckled so that a protuberance 35 arises in the second surface 33. The form of the hook 31 is optimized for transferring filaments which are located in the openings of the picker eyes deeper into the free space of the picker eye volume.

FIGS. 5A to 5C show a schematic front/top view of a cutting of a first example embodiment of a tuft picker comprising a picker eye volume 45 according to the present disclosure. Features which are in common with those shown in FIG. 4 are designated with the same reference numerals and are not described in detail again. The tuft picker comprises two parts, namely a first part 11 and a second part 12 which are spaced by a distance D. Inside said distance D a cover tool 30 as shown in FIG. 4 is arranged. The first and second part 11, 12 of the tuft picker each comprise a working surface 1311, 1312. The cover tool 30 comprises a hook 31, wherein the form of the first surface 32 of the hook 31 corresponds to the form of the working surfaces 1311, 1312. The first and second part 11, 12 of the tuft picker each comprise one picker eye 2011, 2012, wherein the picker eyes 2011, 2012 are located at identical positions in the parts 11, 12 of the tuft picker. That means the working surface 1311 is interrupted by an opening 2211 of the picker eye 2011 and the working surface 1312 is interrupted by an opening 2212 of the picker eye 2012, wherein the openings 2211, 2212 are located one upon the other. The picker eyes 2011 and 2012 are oval recesses, wherein the depth L may be about 1.5 mm and a width B may be about 1.0 mm A volume covered by the first picker eye 2011, the second picker eye 2012 and the distance D in between forms a picker eye volume 45 (FIG. 5A). The picker eye volume 45 is intended to take up filaments 42 during the picking process as shown in FIG. 5B. A part 38 of the cover tool is located inside the picker eye volume 45 thereby limiting the volume of the picker eye volume 45. The cover tool is arranged movable between the two parts 11, 12 of the tuft picker. For example the cover tool is mounted via a hinge 39 to the first and second part 11, 12 of the tuft picker.

FIG. 5C shows the hook 31 in its second position. Features which are in common with those shown in FIGS. 4 to 5B are designated with the same reference numerals and are not described in detail again. The end 34 of the hook 31 is positioned between the first part 11 and the second part 12 at the opposite side of the picker eye openings 2211, 2212 so that the hook 31 closes the building line of the picker eye openings 2211, 2212. Thereby, a part of the picker eye volume 45 is covered by the hook 31. Said decrease in volume is balanced by the part 38.*b* which covers less volume of the picker eye volume 45 compared to FIGS. 5A and 5B, so that the final volume of the picker eye volume 45 which can take up filaments is constant. Alternatively, the net volume of the picker eye volume 45 may slightly increase as the volume covered by the hook 31 may be smaller than the volume released by the part 38. A slightly increased net volume of the picker eye volume 45 makes it easier to transfer the filaments out of the picker eye openings 2211, 2212 deeper into the picker eye volume 45.

FIG. 6 shows a schematic sketch of the embodiment shown in FIG. 5 during one working cycle arranged in a tuft picker, wherein the first part 11 is not shown and the cover tool 30 is shown semi-transparent. Features which are in common with those shown in FIG. 5 are designated with the same reference numerals and are not described in detail again. The cover tool 30 is movable mounted to the tuft picker 10. The hook 31 is located outside the picker eye 2012, in particular outside the building line of the opening 2212 of the picker eye 2012 (FIGS. 6A and 6B) in its first position. A part 38 of the main body of the cover tool 30 is located partly over the picker eye 2012 so that said spaced covered by the part 38 cannot be filled with filaments 42. The opening 2212 of the picker eye 2012 is covered by a counterpart 52 of the tuft picker 10 so that the picker eye 2012 cannot be filled (FIG. 6A). FIG. 6B shows the filaments 42 passing through the opening 2212 into the picker eye 2012, while the counterpart 52 (not shown) is located outside the area of the picker eye 2012. Then the hook 31 is transferred from its first position outside the area of the picker eye 2012 into its second position, wherein the hook 31 is located at the building line of the opening 2212 (FIG. 6C). Thereby the filaments 42 are removed from the opening 2212 and transferred deeper into the picker eye 2012. Therefore the part 38*a* which is partly located over the picker eye 2012 is partly removed from the area of the picker eye 2012. The volume which is released by the main part 38.*a* of the cover tool corresponds to the volume which is needed by the hook 31. FIG. 6D shows the hook 31 in its second position. The hook 31 is completely located in the building line of the opening 2212 of the picker eye 2012 thereby closing the picker eye 2012. The part 38.*b* of the main body which is still located in the area of the picker eye 2012 is the smallest compared to the parts 38, 38.*a* which were located therein when the cover tool is located in its first position (FIG. 6A, 6B) and during the movement (FIG. 6C). The filaments 42 are securely located in the picker eye 20 (FIG. 6D) and can be transferred by the picker eye 20 to any further manufacturing step.

Figure 7A:
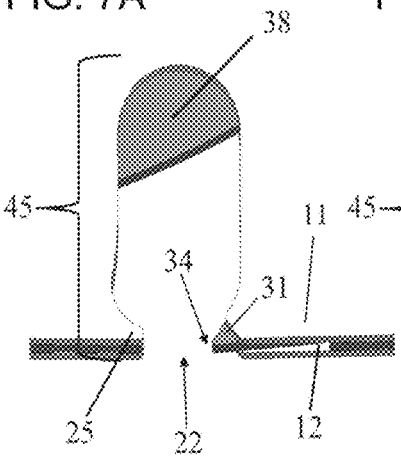
FIG. 7A illustrates a first position of another embodiment of a cover tool.
Figure 7B:
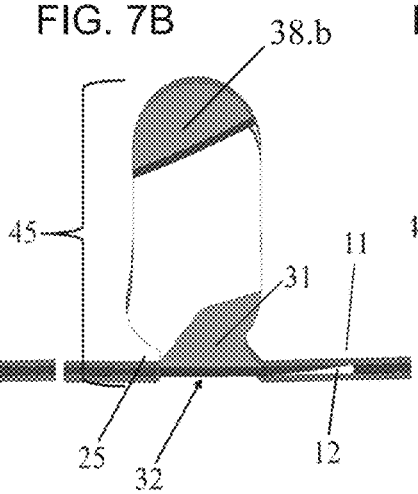
FIG. 7B illustrates a second position of the cover tool shown in FIG. 7A.
Figure 7C:
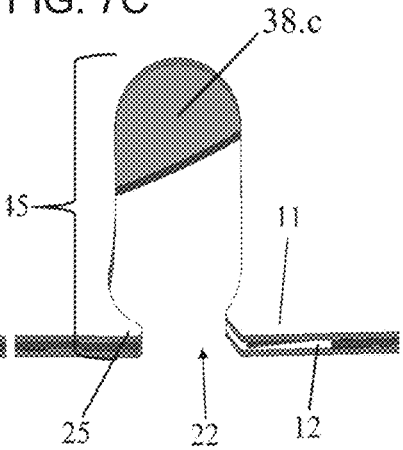
FIG. 7C illustrates an ejection position of the cover tool shown in FIGS. 7A and 7B.

FIG. 7 show another embodiment of a cover tool, wherein the first position is different to the embodiment shown in FIG. 6 and an additional ejection position exists. Features which are in common with those shown in FIGS. 4 to 6 are designated with the same reference numerals and are not described in detail again. In the first position of the cover tool the end 34 of the hook 31 protrudes slightly into the opening 22 of the picker eye volume 45 and the part 38 covers the base of the picker eye volume 45 (FIG. 7A). During the movement of the cover tool the hook 31 moves from said first position to a position inside of the picker eye volume 45, namely the second position (FIG. 7B). Thereby the second surface 32 of the hook 31 is located at the building line of the picker eye openings 2211, 2212 and the hook 31 is located in the picker eye volume 45. In parallel to the movement of the hook 31 inside the picker eye volume 45 the part 38 of the cover tool moves out of the picker eye volume 45. That means the volume covered by the part 38.*b* (FIG. 7B) is smaller than the volume covered by the part 38 (FIG. 7A). Thus, due to parallel movement of the part 38 and the hook 31 the net volume of the picker eye volume 45 is constant. Alternatively, the volume of the picker eye volume 45 may slightly increase from first to second position of the hook 31 which slightly simplifies to remove the filaments out of the picker eye openings 22. FIG. 7C shows an additional ejection position. In the ejection position the hook 31 of the cover tool is completely removed from the opening 22. That means, the end 34 of the hook 31 is located completely between the first part 11 and the second part 12 of the tuft picker so that the size of the opening 22 is maximized. In parallel the base part 38.*c* of the cover tool is further moved into the picker eye volume 45, i.e. the part 38.*c* (FIG. 7C) is larger than the part 38 (FIG. 7A). Thereby the filaments are actively pushed by the part 38.*c* in the direction of the opening 22 so that removal of the filaments out of the picker ye volume 45 is simplified. The movement cycle of the cover tool as shown in FIG. 7 can be combined with every other form of the hook 31 or the cover tool itself.

Figure 8A:
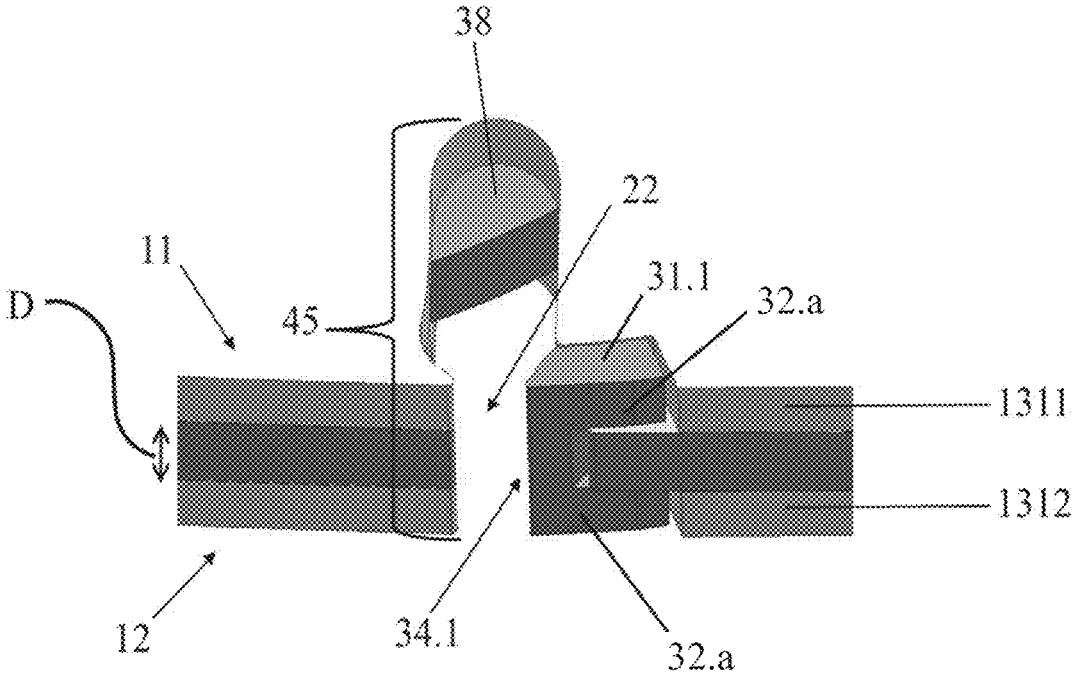
FIG. 8A shows a schematic sketch of an embodiment of a hook of a cover tool in its first position.
Figure 8B:
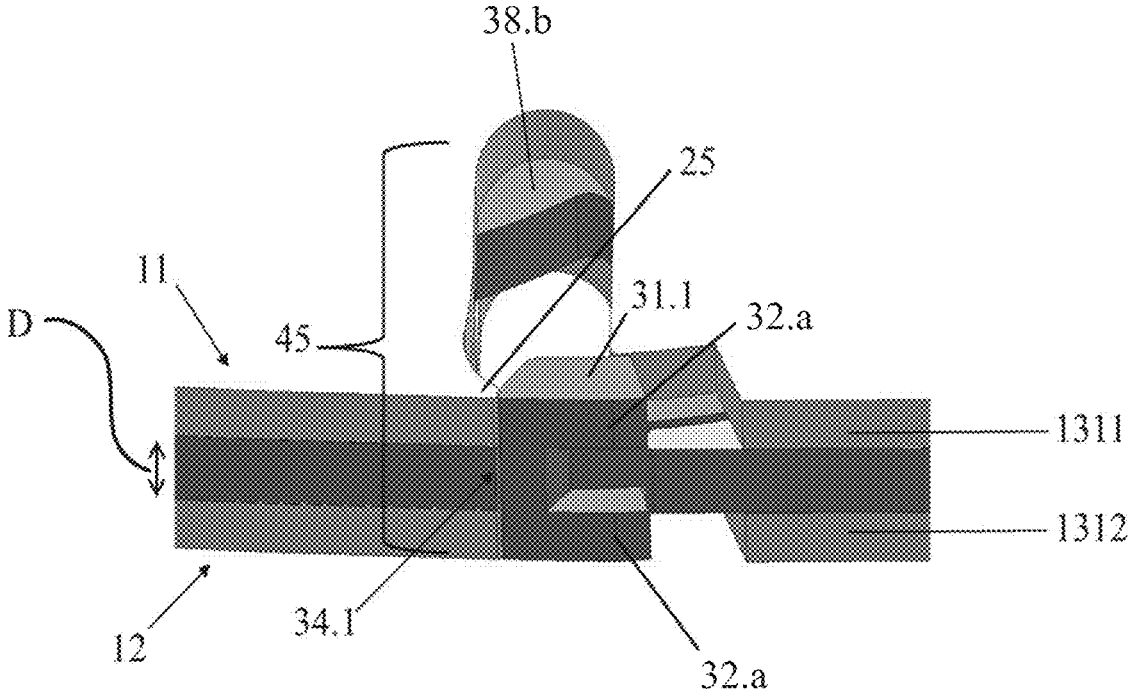
FIG. 8B shows a schematic sketch of an embodiment of a hook of a cover tool in its second position.

FIG. 8A shows a schematic front/top view of a cutting of another example embodiment of a tuft picker comprising a picker eye volume 45 with a cover tool 30 according to the present disclosure. Features which are in common with those shown in FIGS. 4 to 7 are designated with the same reference numerals and are not described in detail again. The embodiment of the cover tool 30 shown in FIGS. 8A and 8B comprises a different hook 31.1. The hook 31.1 is U-shaped, wherein the sides of the U-shaped hook 31.1 are located in the working surfaces 1311, 1312 of the first and second parts 11, 12 so that the first surface 32.*a* of the hook 31.1 protrudes from the parts 11, 12. That means the end 34.1 is not located between the two parts 11, 12 in the distance D in the first position of the cover tool, but forms a part of the working surfaces 1311, 1312. In the second position of the cover tool, the hook 31.1 closes the picker eye volume 45 (FIG. 8B). Thereby, the end 34.1 and the protrusion 25 closes the working surfaces 1311, 1312 in the area of the picker eye volume 45.

Figure 8C:
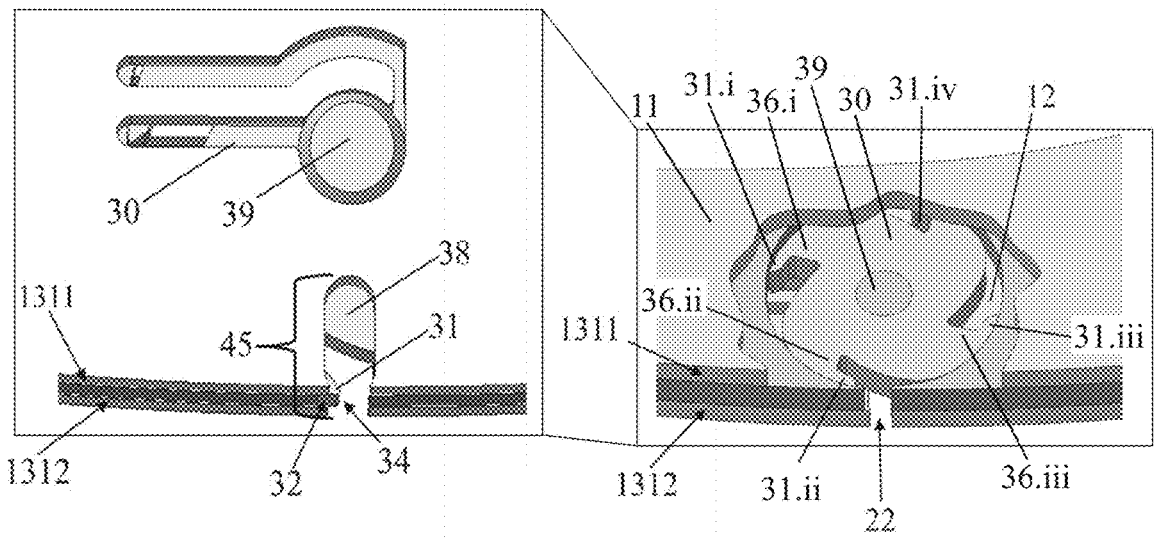
FIG. 8C shows a schematic sketch of an embodiment of a circular cover tool comprising four hooks and spacers, wherein hooks and spacers are of different sizes.

FIG. 8C shows a schematic front/top view of a cutting of another example embodiment of a tuft picker comprising a circular cover tool 30. Features which are in common with those shown in FIGS. 4 to 8B are designated with the same reference numerals and are not described in detail again. The circular cover tool 30 comprises four hooks 31*i*, 31*ii*, 31*iii*, 31*iv* and four spacers 36*i*, 36*ii*, 36*iii*, 36*iv* which are arranged around the surface of the cover tool 30. The cover tool 30 is embedded into the first part 11 and second part 12 of the tuft picker via a hinge 39 which keeps the cover tool 30 in place, but allows rotation. Thus, the cover tool 30 allows different hooks 31*i*-31*iv* to be located in the picker eye volume 45. In FIG. 8C, the first part 11 is removed in the area of the cover tool 30 in order to show the circular cover tool 30 completely. Due to the fact that the hooks 31*i*-31*iv* and spacers 36*i*-36*iv* are of different size the final volume of the picker eye volume 45 which can be filled with filaments is different. Thus, different sizes of the eyes, i.e. different numbers of filament which are picked, can be provides by using a cover tool 30 as shown in FIG. 8C.

Figure 8D:
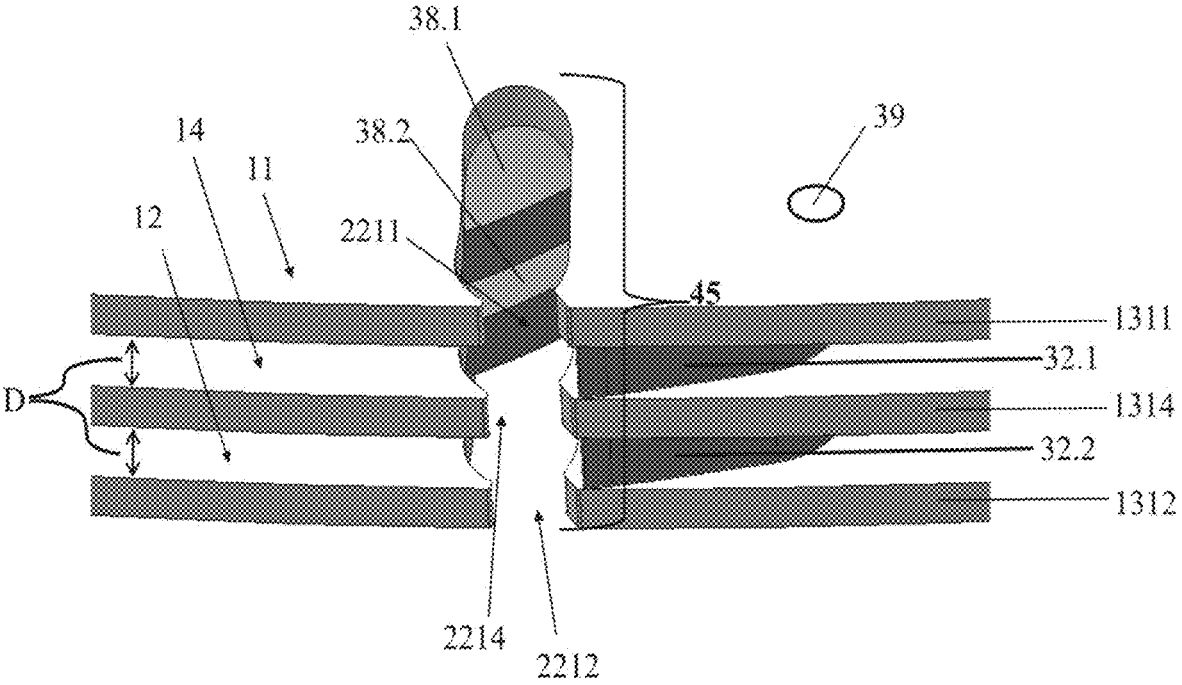
FIG. 8D shows a schematic sketch of another embodiment of a tuft picker comprising a first part, a second part and third part, wherein one cover tool is arranged between the first and the third parts and the third and the second part.

FIG. 8D shows a schematic front/top view of a cutting of another example embodiment of a tuft picker comprising a picker eye volume 45 according to the present disclosure. Features which are in common with those shown in FIGS. 4 to 8B are designated with the same reference numerals and are not described in detail again The tuft picker shown in FIG. 8C comprises three parts, namely a first part 11, a second part 12 and a third part 14. The third part 14 is located between the first part 11 and the second part 12, wherein the first and the third part 11, 14 as well as the third and the second part 14, 12 are spaced by a distance D, respectively. Inside each of said distances D a cover tool is arranged, wherein the cover tools are located at identical positions and are of identical shape and dimensions compared to each other. The first, second and third part 11, 12, 14 of the tuft picker each comprise a working surface 1311, 1312, 1314. The cover tools each comprise a hook, wherein only a first surface 32.1, 32.2 of each of the hooks can be seen in FIG. 8C. The form of the first surfaces 32.1, 32.2 of the hooks corresponds to the working surfaces 1311, 1312, 1314. The first, the second and the third part 11, 12, 14 of the tuft picker each comprise one picker eye located at identical positions in the parts 11, 12, 14. That means the working surfaces 1311, 1312, 1314 are each interrupted by an opening 2211, 2214, 2212, wherein the openings 2211, 2214, 2212 are located one upon the other. The volume covered by the picker eyes in the first part 11, the second part 12 and the third part 14 as well as the distances D in between forms a picker eye volume 45 intended to take up filaments during the picking process. A part 38.1, 38.2 of the cover tools is located inside the picker eye volume 45 thereby limiting the volume of the picker eye volume 45 which can be filled. The cover tools are arranged movable between the first and the third part 11, 14 as well as the third and the second part 14, 12. For example the cover tools are mounted via a hinge 39 to the tuft picker parts 11, 12, 14. Mounting both cover tools with one hinge 39 allows a parallel movement of the cover tools compared to the picker eye volume 45.

Figure 9:
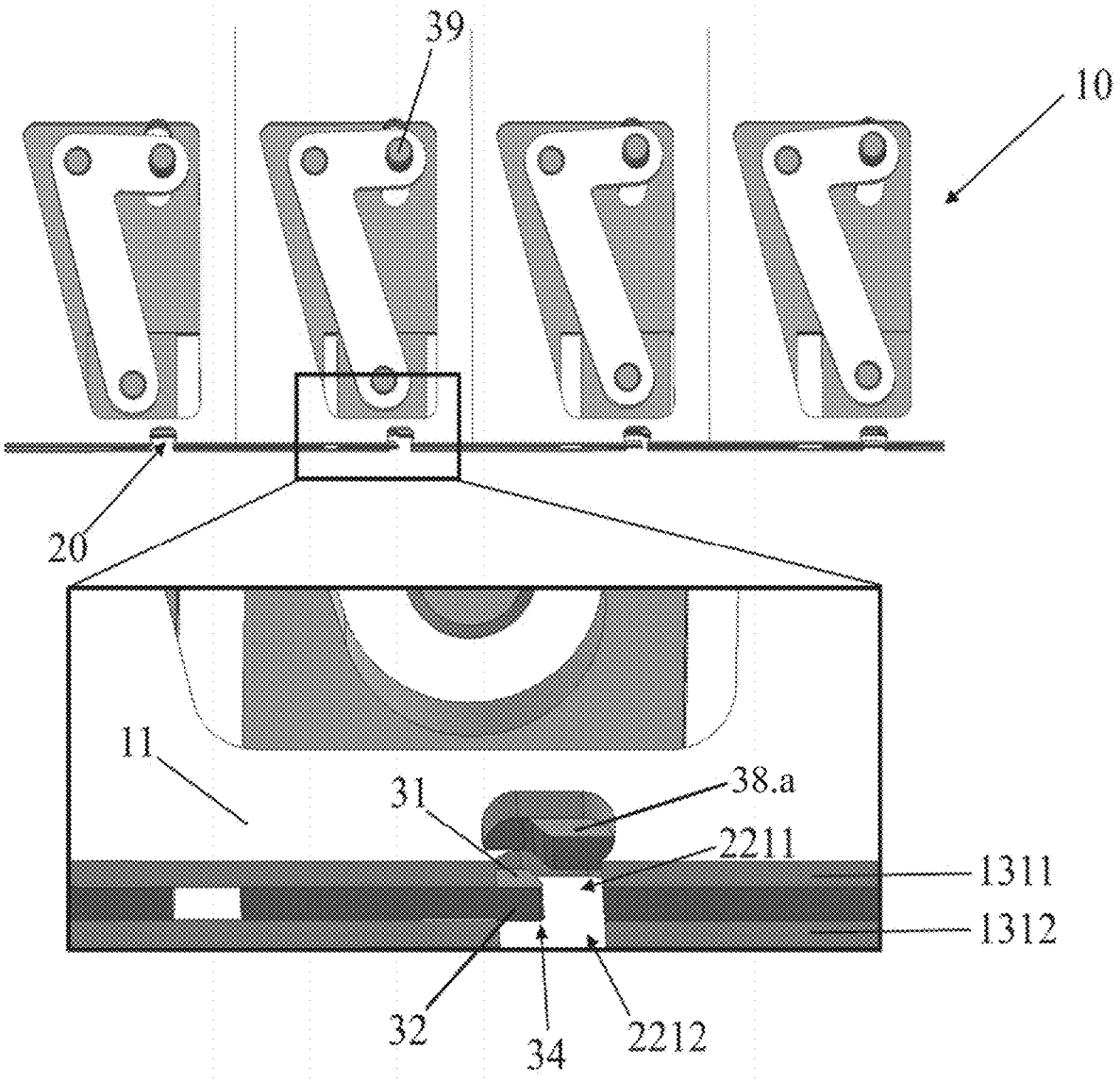
FIG. 9 shows a schematic sketch of a linear tuft picker comprising several picker eyes arranged adjacent to each other in straight working surfaces.

FIG. 9 shows a schematic top view of a linear tuft picker 10 comprising several picker eyes 20 according to the present invention which are arranged adjacent to each other in straight working surfaces 1311, 1312. Features which are in common with those shown in FIGS. 4 and 5 are designated with the same reference numerals and are not described in detail again. Four picker eyes 20 are arranged adjacent to each other in a straight tuft picker 10. The picker eyes 20 all comprise a cover tool as disclosed above and shown in greater detail in FIG. 5. The detailed view in FIG. 9 shows the cover tool 30 during movement from its first into its second position. The hook 31 is partly located in the building line of the openings 2211, 2212 of the picker eye 20 and the part 38.*a* is partly removed.

Figure 10:
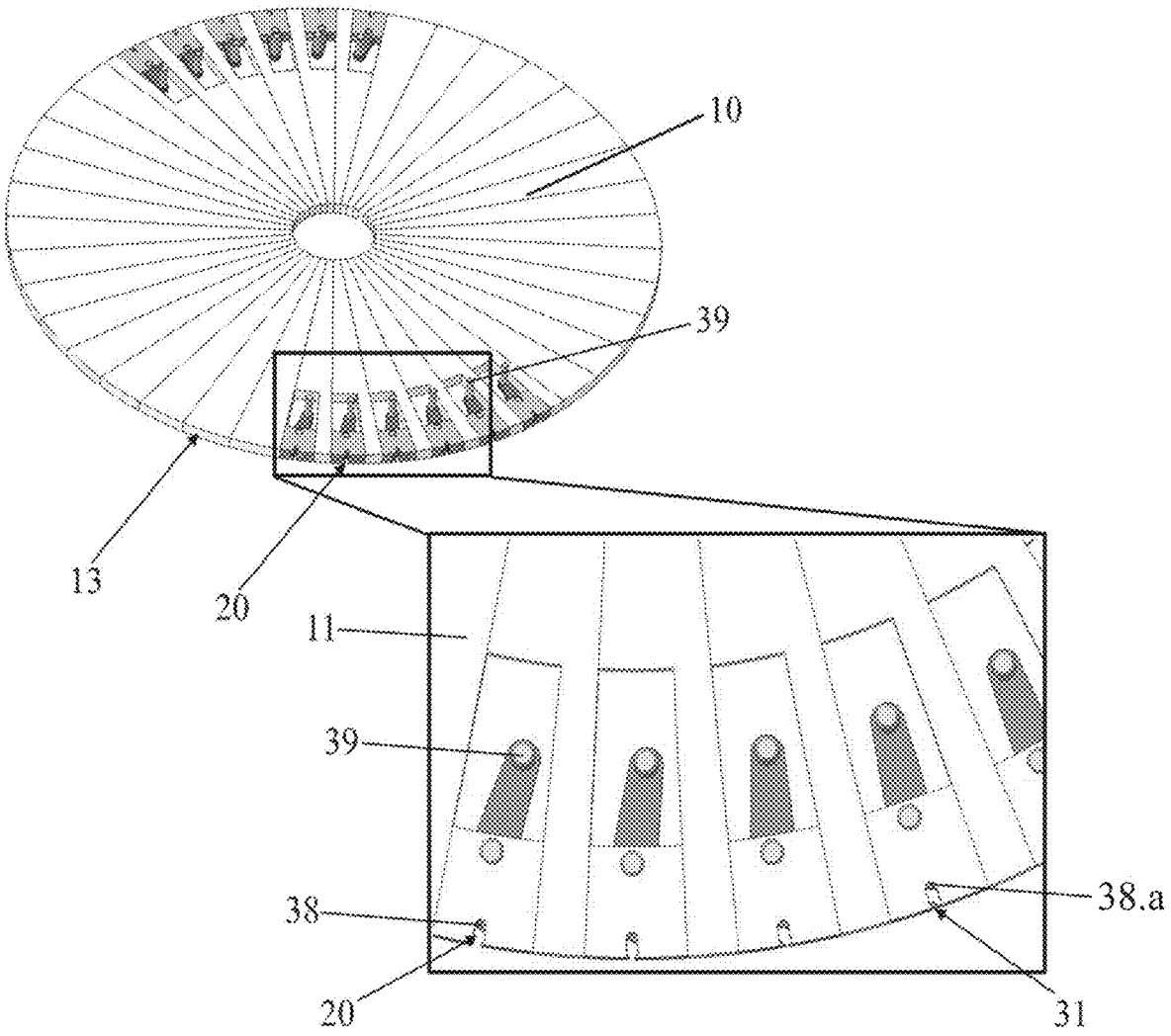
FIG. 10 shows a schematic sketch of a circular tuft picker comprising several picker eyes arranged adjacent to each other in circular working surfaces.

FIG. 10 shows a schematic top view of a circular tuft picker 10 comprising several picker eyes 20 according to the present invention which are arranged adjacent to each other. Features which are in common with those shown in FIGS. 4 and 5 are designated with the same reference numerals and are not described in detail again. Six picker eyes 20 are arranged adjacent to each other on the circular working surface 13 of the tuft picker 10. Two sets of six picker eyes 20 are arranged at opposite sides of the tuft picker circle 10. The picker eyes 20 all comprise a cover tool as disclosed above and shown in greater detail in FIG. 5. The detailed view in FIG. 10 shows the five cover tools 30 at different time points during movement from their first into their second position. For example, the first picker eye 20 shown on the left side is completely open, i.e. the cover tool is arranged in its first position. Thus, the part 38 is located completely in the picker eye and the hook is removed from the opening of the picker eye. The picker eye 20 which is shown on the right side of the detailed view is completely closed, i.e. the cover tool is arranged in its second position. Thus, the hook 31 closes the opening 22 of the picker eye 20 and the part 38.*b* is removed from the picker eye in such that the volume of the picker eye is kept constant.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tuft picker comprising:

a first part and a second part spaced by a distance, wherein each of the first part and the second part comprises a working surface including at least one picker eye having an opening in the working surface, wherein the opening in the first part and the opening in the second part are located at identical positions at the working surfaces and are spaced by the distance, thereby forming a picker eye volume comprising the picker eye of the first part, the picker eye of the second part, and an interspace therebetween; and a cover tool located between the first part and the second part, wherein the cover tool comprises a main body and a hook connected by a spacer to the main body, wherein the hook terminates with an end and has a first surface and a second surface, wherein the first surface corresponds to the working surfaces at the openings of the first and second parts;

wherein the cover tool is structured and configured to be movable relative to the picker eye volume from a first position to a second position, wherein the hook is located outside the picker eye volume in the first position of the cover tool, wherein the hook is located inside the picker eye volume in the second position of the cover tool thereby limiting the picker eye volume at the interspace at a common building line of the working surfaces, and wherein a part of the main body of the cover tool is located inside the picker eye volume when the cover tool is in the first position, thereby reducing the picker eye volume in the first position of the cover tool when the hook is located outside the picker eye volume.

2. The tuft picker of claim 1, wherein the part of the cover tool's main body located inside the picker eye volume in the first position of the cover tool is at least partially removed from the picker eye volume when the cover tool moves from its first position into its second position.

3. The tuft picker of claim 2, wherein a portion of the picker eye volume covered by the part of the cover tool's main body in the first position of the cover tool is identical to or larger than a portion of the picker eye volume covered by the hook in the second position of the cover tool.

4. The tuft picker of claim 1, wherein the second surface of the hook is adapted to transfer objects to be located inside the picker eye volume deeper into the picker eye volume and away from the building lines of the working surfaces at the openings of the picker eyes.

5. The tuft picker of claim 4, wherein a width of the hook increases from the end of the hook towards the spacer, wherein the width is from about 0.01 mm to about 0.1 mm at the end and from about 0.1 mm to about 5 mm at the spacer.

6. The tuft picker of claim 4, wherein the end of the hook of the cover tool is rounded and the second surface of the cover tool is chamfered from the end to the spacer.

7. The tuft picker of claim 1, wherein the second surface of the hook comprises a protuberance.

8. The tuft picker of claim 1, wherein each of the working surfaces of the first part and the second part of the tuft picker comprises a circular arc having a curvature diameter of from 20 mm to 200 mm.

9. The tuft picker of claim 1, wherein the openings of the picker eyes are smaller than a width of the picker eyes, wherein at least one protrusion protrudes into the openings at a side of the openings where the end of the hook is located in the second position of the cover tool.

10. The tuft picker of claim 9, wherein a shape of the end of the hook corresponds to a shape of the at least one protrusion.

11. The tuft picker of claim 1, wherein the picker eyes have a shape comprising a circle or an oval.

12. The tuft picker of claim 1, wherein the picker eyes have a shape of an oval having a width of from about 1 mm to about 8 mm and a depth of from about 0.4 mm to about 4 mm.

13. The tuft picker of claim 1, wherein the tuft picker is structured and configured to oscillate along a part of a circular arc from a starting position to a reversal point, wherein the cover tool moves from its first position into its second position before the tuft picker reaches the reversal point.

14. The tuft picker of claim 13, wherein the cover tool stays in its second position when the tuft picker is oscillating back into its starting position.

* * * * *